United States Patent [19]

McCarty

[11] Patent Number: 4,586,347

[45] Date of Patent: May 6, 1986

[54] INTERMEDIATE TEMPERATURE STORAGE CHAMBER

[75] Inventor: William J. McCarty, Louisville, Ky.

[73] Assignee: General Electric Co., Louisville, Ky.

[21] Appl. No.: 648,328

[22] Filed: Sep. 7, 1984

[51] Int. Cl.[4] ..... F25D 23/02

[52] U.S. Cl. ..... 62/265; 62/377; 62/408

[58] Field of Search ..... 312/292; 62/265, 377, 62/408

[56] References Cited

U.S. PATENT DOCUMENTS

| | | | |
|---|---|---|---|
| 1,727,777 | 9/1929 | Juneau | 62/408 X |
| 2,234,862 | 3/1941 | Gonczi | 62/408 |
| 2,382,084 | 8/1945 | Mathews | 62/408 X |
| 2,444,887 | 7/1948 | Wyeth . | |
| 2,482,915 | 9/1949 | Kaboskey et al. | 62/408 |
| 3,078,688 | 2/1963 | Petkwitz | 62/159 |
| 3,218,111 | 11/1965 | Steiner | 312/214 |
| 3,561,231 | 2/1971 | Webb | 62/377 X |
| 3,659,429 | 5/1972 | McLean | 62/157 |
| 3,759,053 | 9/1973 | Swaneck, Jr. | 62/187 X |
| 4,368,622 | 1/1983 | Brooks | 62/157 |

*Primary Examiner*—William E. Wayner

*Attorney, Agent, or Firm*—F. P. Giacalone; R. M. Reams

[57] ABSTRACT

A refrigerator comprising side-by-side freezer and fresh food storage compartments cooled to their respective low and high operating temperatures by the circulation of streams of below-freezing air thereto includes a storage chamber in the fresh food compartment door maintained at an intermediate temperature by conducting air from the freezer compartment through the chamber.

8 Claims, 6 Drawing Figures

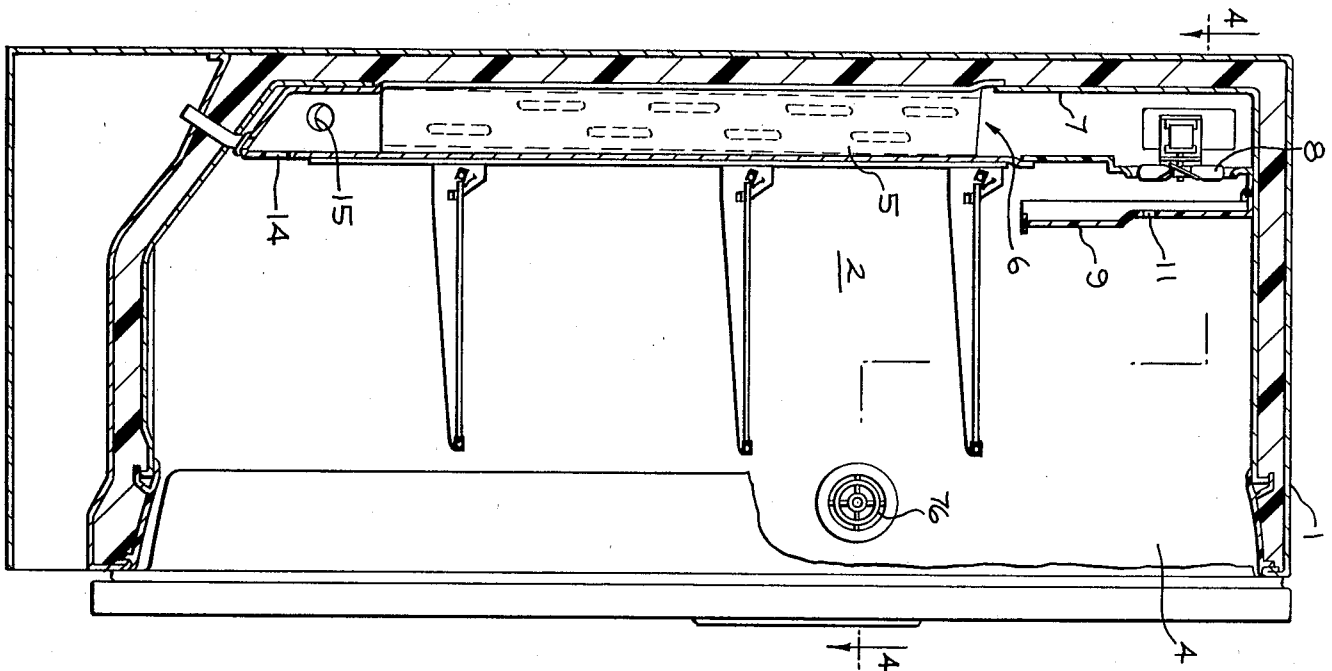
FIG. 3
FIG. 2
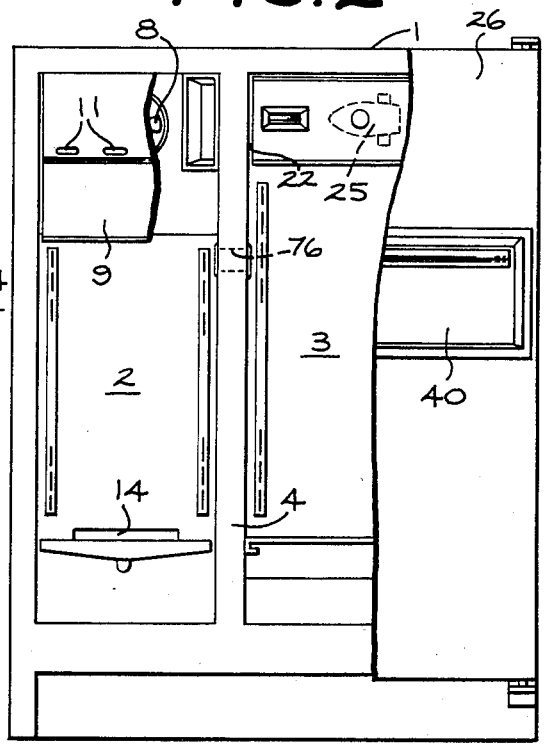
FIG. 1
PRIOR ART
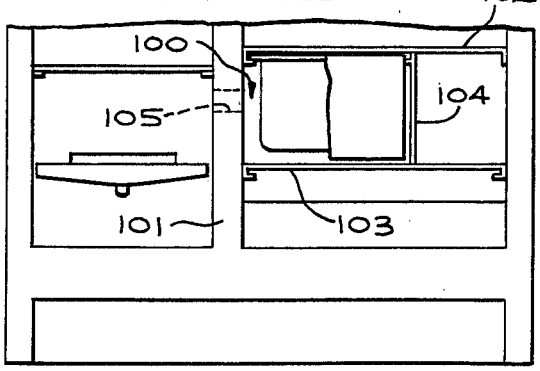

INTERMEDIATE TEMPERATURE STORAGE CHAMBER

BACKGROUND OF THE INVENTION

Combination refrigerators including a single evaporator and a single fan for circulating air from the freezer and fresh food compartments over the evaporator are well known. In operation of such forced air circulating refrigerators a major portion of the refrigerated or below-freezing air from the evaporator is directed into the freezer compartment while a smaller portion is directed into the fresh food compartment. The refrigerated air is generally so proportioned between the compartments as to maintain the freezer compartment at substantially below-freezing temperatures and the fresh food compartment at above-freezing temperatures, for example, within the range of from 35°–40° F. It is also well known that for the short term storage of certain food stuffs, such as beverages, a storage temperature at or slightly above freezing but somewhat lower than the usual fresh food storage compartment temperature as for example a temperature of 28°–34° F. is desirable. In refrigerators of the forced air circulating type including a storage chamber for providing an intermediate storage temperature for certain foods the intermediate temperature condition has normally been obtained by introducing into the storage chamber a portion of the below-freezing air directly from the evaporator. At the minimum, this practice has required a separate duct or separate air outlet for conducting some of the refrigerated air directly to the intermediate temperature storage chamber. In other prior art systems a portion of the below-freezing air has been directed from the evaporator to specific portions of the fresh food compartment.

SUMMARY OF THE INVENTION

The present invention is directed to a single fan, single evaporator combination refrigerator including a chamber or volume within the fresh food compartment door of the refrigerator for the storage of food stuffs at an intermediate temperature which is somewhat below the usual fresh food storage compartment temperatures. In accordance with the present invention, this intermediate temperature storage chamber is disposed in the fresh food compartment door adjacent the partition dividing the freezer and fresh food storage compartments. The desired intermediate temperatures are maintained by introducing air from the freezer compartment into the intermediate temperature volume of the storage chamber through a port or passage in the partition thereby eliminating the usual special duct or outlet previously employed for conducting refrigerated air directly from the evaporator to such chamber. In order to assure a circulation of the freezer compartment air into and through the intermediate temperature storage chamber the air return means for returning freezer and fresh food compartment air through the evaporator are so proportioned as to maintain a slightly higher pressure within the freezer compartment than within the fresh food compartment.

BRIEF DESCRIPTION OF THE DRAWINGS

FIG. 1 is a partial elevational view of portions of a prior art refrigerator;

FIG. 2 is an elevational view of portions of a side-by-side combination refrigerator incorporating the present invention;

FIG. 3 is a vertical sectional view of the cabinet as illustrated in FIG. 2 taken along line 3—3 of FIG. 2;

DESCRIPTION OF THE PREFERRED EMBODIMENT

Figure 4:
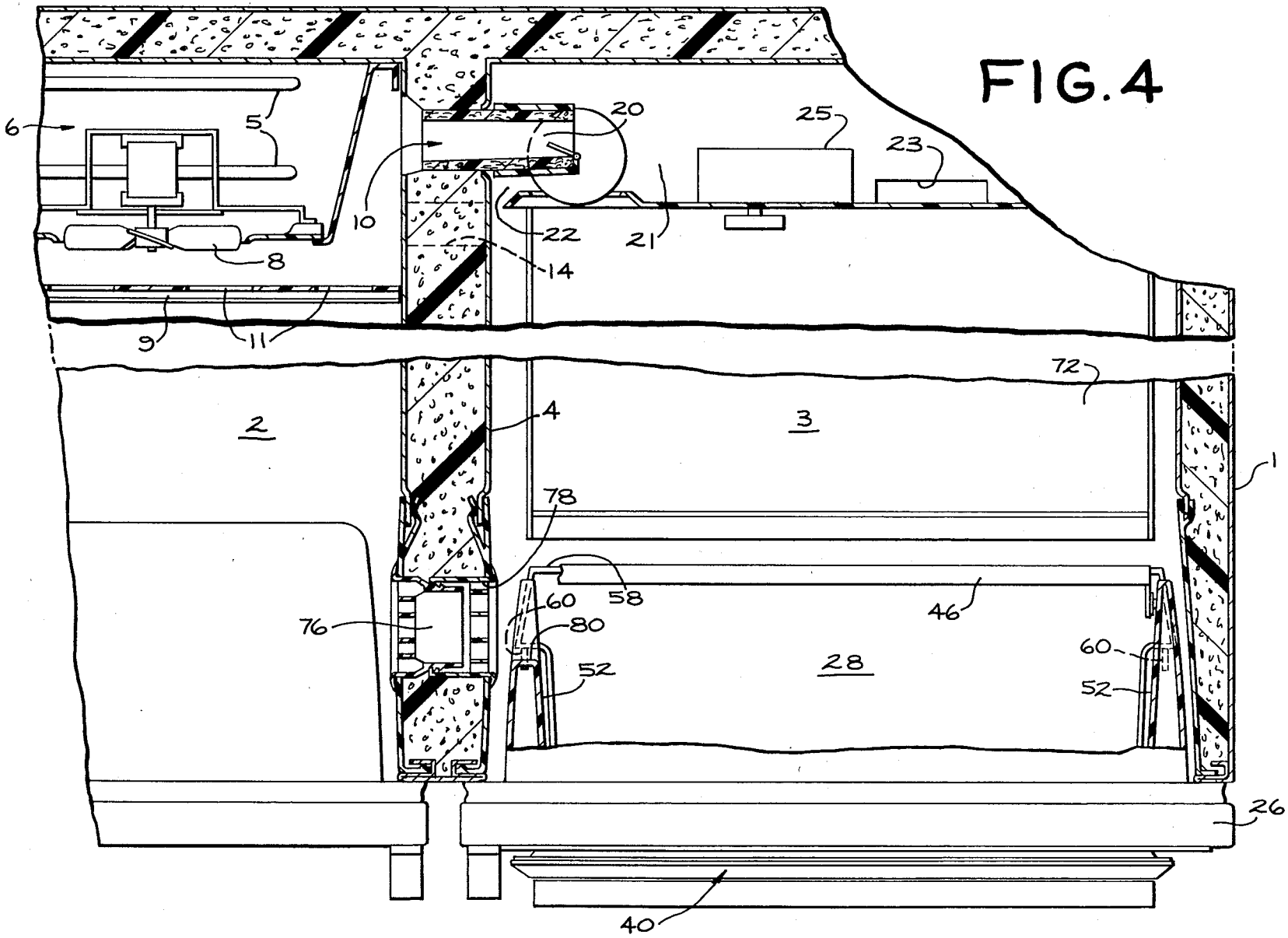
FIG. 4 is a sectional plan view taken generally along line 4—4 of FIG. 3.

In the side-by-side refrigerator of the type employed in carrying out the present invention separate chambers have been provided as shown in FIG. 1 designated "PRIOR ART". The chamber 100 therein was provided in the lower portion of the fresh food compartment adjacent the partition 101. The chamber 100 is defined by a solid shelf 102 forming the top of the chamber, a solid shelf 103 forming the bottom of the chamber and a vertical partition 104 forming the wall of the chamber opposite the wall defined by the partition. This chamber is maintained at a selected temperature range by conducting a controlled amount of below-freezing air from the freezer compartment into the chamber 100 through an air supply passage 105. To gain access to the chamber 100 it was necessary to open the refrigerator door which caused a substantial loss of cold refrigerated air.

In the exemplary embodiment of the invention as disclosed in the drawings and more particularly to FIGS. 2–4, there is shown a refrigerator cabinet 1 including a freezer compartment 2 and a fresh food storage compartment 3 arranged in side-by-side relationship and divided by means of a vertical partition 4.

A single evaporator 5 for refrigerating the two compartments 2 and 3 is contained within an evaporator chamber or housing 6 extending vertically along the rear wall 7 of the freezer compartment. A single fan 8 mounted in the upper portion of the evaporator chamber 6 draws separate air streams from the two compartments 2 and 3 through the evaporator chamber 6 and discharges air cooled to a below-freezing temperature by the evaporator 5 into the upper portions of the freezer compartment 2. A vertical baffle 9 extending substantially the full width of the freezer compartment 2 in front of the fan 8 diverts a portion of this refrigerated air to a fresh food air supply passage 10 provided in the partition 4 while the remaining and major portion of the refrigerated air flows generally downwardly into the freezer compartment 2 and forward through vents 11 in the vertical baffle 9. Air from the freezer compartment is drawn into the evaporator chamber 6 through a freezer air return passage 14 provided in the lower portion of the housing 6 below the evaporator 5 while return air from the fresh food compartment 3 flows into the lower portion of the housing 6 through a fresh food air return passage 15 extending through the partition 4. These two return air streams mingle below the evaporator 5 and the mingled air is cooled by the evaporator 5 to below-freezing temperatures.

The refrigerated air supplied to the fresh food compartment through the passage 10 is first mixed with air within the fresh food compartment 3 before being introduced into that compartment. The passage 10, specifically the outlet thereof, (FIG. 4) is in the general shape of a nozzle 20 extending into a horizontally disposed mixing chamber 21. The end of the mixing chamber adjacent the partition 4 is spaced from the partition to provide one or more passages 22 through which an induced flow of air from the fresh food compartment into the mixing chamber 21 is affected by the discharge of air from the nozzle 20. The mixture of fresh food compartment air and refrigerated air is discharged from the opposite end of the chamber 21 through one or more air outlets 23 provided in the bottom of that chamber. Thermostatic control means 25 mounted within the chamber 21 senses the temperature of the mixed air and controls the operation of the refrigerant condensing means (not shown) for supplying condensed refrigerant to the evaportor 5 and the operation of the fan 8.

Figure 5:
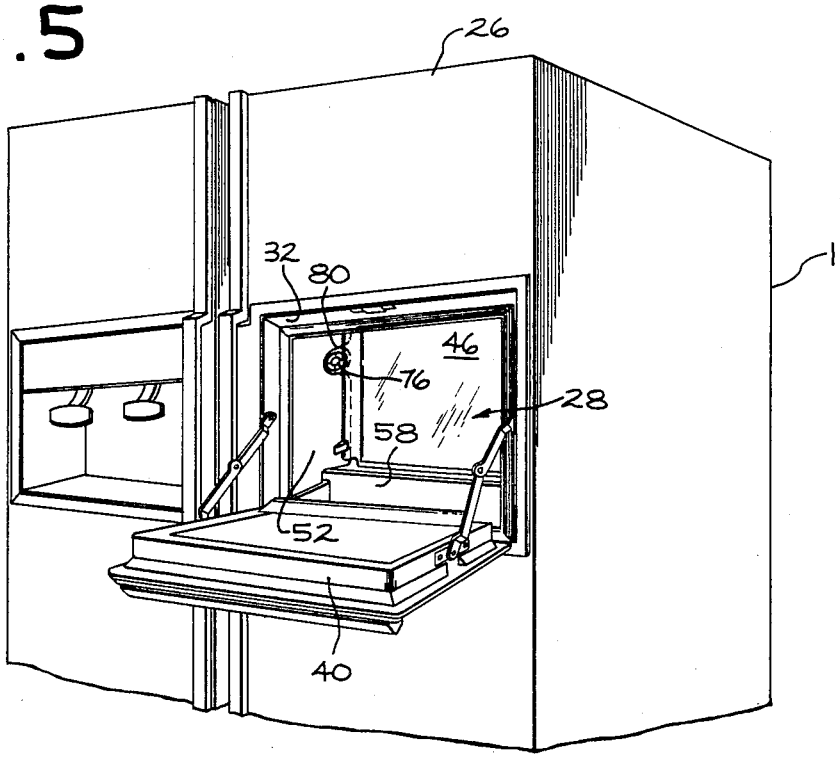
FIG. 5 is a perspective view of a portion of the side-by-side refrigerator including the storage chamber of the present invention.
Figure 6:
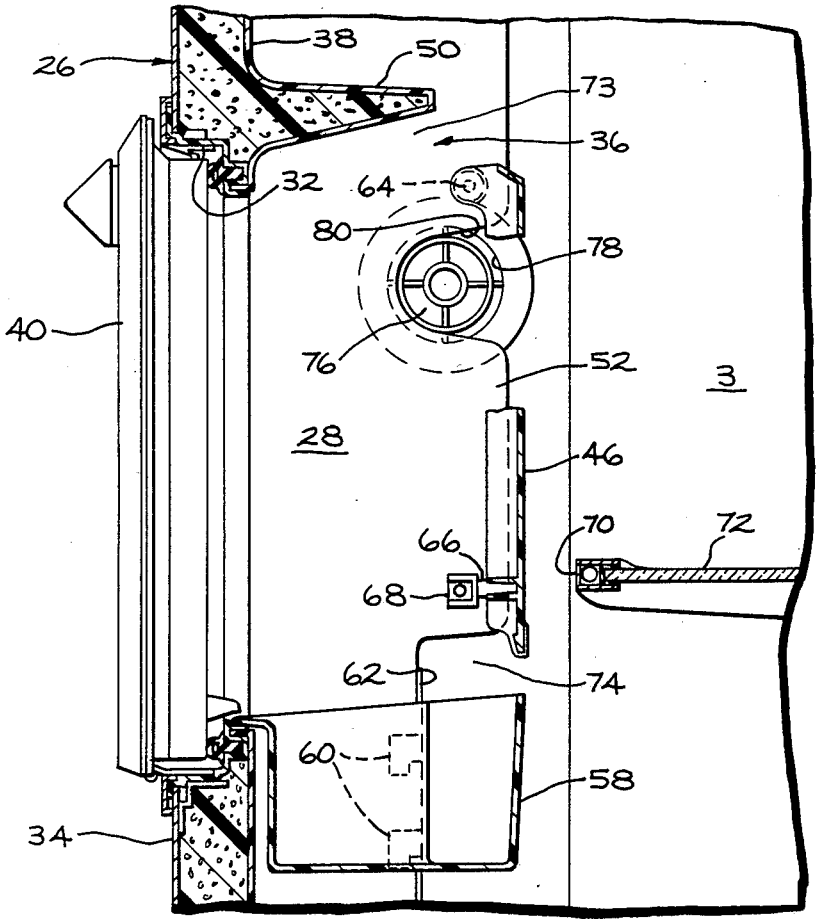
FIG. 6 is a side elevational cross-sectional view of the storage chamber of the present invention.

As has been previously stated it is desirable to provide a special chamber or storage volume for the preservation of certain food stuffs at a temperature above the freezer compartment temperature but below the temperature normally maintained in a fresh food compartment. In the refrigerator of the present invention such a chamber is provided in the door 26 closing the access opening to the fresh food compartment 3. Accordingly, as shown in FIGS. 4–6, there is located on the fresh food door 26 is a food storage chamber assembly of the present invention. The assembly includes a storage chamber 28 in the fresh food door 26 with an outer access opening 32 in the outer door member 34 and an inner access opening 36 in an inner door member 38.

An outer closure 40 is pivotally mounted at the bottom thereof to the outer door member 34 for sealing the outer access opening 32 in a first position as shown in FIGS. 4 and 6 and pivotally movable outwardly therefrom to a second open horizontal counter position as shown in FIG. 5. An inner closure 46 is pivotally mounted to the inner door member 38 for partially sealing the inner access opening 32 in the inner door in a first position as shown in FIG. 6 and to a second open position (not shown) for access to chamber 28.

The storage chamber 28 is formed between the outer closure 40 and the inner closure 46 and by a horizontal dike 50 formed in the inside of the door member 38 at the top of the chamber 28 and two side vertical dikes 52. The horizontal dike 50 in a door shelf may be employed for holding food and beverage articles. At the bottom of the compartment 28 is a removably mounted receptacle 58 which is held in place by hook-shaped projections 60 that mate with slots in vertical tracks 62 secured to the inner door member 38. The receptacle 58 holds the beverage bottles and food stuffs that will be stored in the compartment 28 and it may be removed for cleaning by disengaging the hook-shaped projection from the track slots. The inner closure 46 is preferably formed of plastic and is secured to the two vertical dikes 52 of the inner door member 38 by pivot members 64, one at each of the upper corners of the inner closure 46. The lower edge of the inner closure 46 at each corner has a projection 66 in the form of a rubber bumper that projects inwardly to the chamber 28 and when the inner closure 46 is in the closed position as shown in FIG. 6 they contact stop members 68, one on each of the vertical dikes 52. With this arrangement when the fresh food door 26 is in its open position (not shown) the inner closure 46 may be raised by pivoting it about the pivots 64 to gain access to the chamber 28. When the door 26 is in its closed position, the inner closure 46 is spaced from but in close proximity to the front edge 70 of shelf 72 so that the inner closure 46 cannot be opened from outside the refrigerator when the outer closure 40 is in its open horizontal position shown in FIG. 5. For air flow purposes there are two openings into the compartment 28 from the fresh food compartment 3 when the inner closure 46 is in its closed position. One opening 73 is at the top of the chamber between the horizontal dike 50 and the top of the inner closure 46 and the other opening 74 is at the bottom between the receptacle 58 and the bottom of the inner closure 46. Thus, with this arrangement the inner closure 46 partially seals the inner access opening of the compartment 28 and when the outer closure 40 is in its open horizontal position cold air from the fresh food compartment 3 will only have minimum leakage through the chamber 28. Further, the openings 73 and 74 allow for the circulation of air through the chamber 28 during operation of the fan 8.

By the present invention means are provided for maintaining the chamber 28 at a temperature somewhat below that of the fresh food compartment 3. This is accomplished by conducting a controlled amount of below-freezing air from the freezing compartment 2 into the chamber 28 through an air supply passage 76 in the partition 4. The outlet 78 of passage 76 is located so as to communicate with the chamber 28 generally between the closure 40 and 46.

As shown in FIG. 4 the dike 52 on the partition 4 side of the fresh food door 26 is in close proximity to the partition with the outlet 78 of passage 76. The portion of the dike 52 in alignment with the outlet end 78 of passage 76 is formed to include an opening or chamber inlet 80 which communicates with outlet end 78. Accordingly, a portion of the air from the freezer compartment 2 exiting outlet 78 flows directly into the chamber 28.

The air introduced into the chamber 28 through the passage 76 passes outwardly from the rear of chamber 28 through opening 73 and 74 to become mixed with the air from the fresh food compartment 2 before returning to the lower portion of the evaporator housing 6 through the passage 15.

In order to assure a flow of air from the freezer compartment into the fresh food compartment the air passages 14 in the freezer compartment and 15 in the fresh food compartment are so proportioned with reference to the amount of refrigerated air supplied to these two compartments that there is maintained a positive pressure gradient between the freezer compartment 2 and the fresh food compartment 3. Thus, by positioning the chamber 28 adjacent the partition 4 so that its inlet 80 communicates with the aligned outlet 78 of passage 76 the intermediate temperature condition is maintained within the chamber 28 by use of freezer air thereby eliminating the usual ducts previously employed for supplying the air directly from the evaporator fan 8.

It should be apparent to those skilled in the art that the embodiment described heretofore is considered to be the presently preferred form of this invention. In accordance with the Patent Statues, changes may be made in the disclosed apparatus and the manner in which it is used without actually departing from the true spirit and scope of this invention.

What is claimed is:

1. In a refrigerator comprising an insulated cabinet containing freezer and fresh food storage compartments separated by an insulated partition and having separate access openings at the front of said cabinet:

a door having an outer door member and an inner door member movable to open and close said access opening to said fresh food storage compartment;

an evaporator chamber in said freezer compartment;

an evaporator in said evaporator chamber;

air supply means including fan means for drawing return air from both of said compartments over said evaporator and discharging refrigerated air into said freezer compartment and into said fresh food compartment;

wall means on said inner door member defining a storage chamber separate from said fresh food storage compartment;

means on said outer door member forming an exterior access opening leading into said storage chamber;

a secondary door on said outer door member movable to open and close said exterior access opening for providing access to said storage chamber; and means for maintaining a desired temperature in said storage chamber comprising a conduit in said partition and a passageway in said wall means of said storage chamber positioned so as to communicate with said conduit when said door is in its closed position for conveying a controlled amount of refrigerated air from said freezer compartment to said storage chamber to thereby maintain said storage chamber at said desired temperature and to replenish refrigerated air to said storage chamber lost to outside ambient when said secondary door is in its open position.

2. The refrigerator recited in claim 1 whereby the wall means on said door includes vertical dikes formed on an inner door member spaced to provide the side walls of said storage chamber, and a horizontal dike providing the top wall of said storage chamber.

3. The refrigerator received in claim 2 whereby said wall means further including a receptacle extending horizontally between said vertical dikes defining the lower wall of said storage chamber.

4. The refrigerator recited in claim 3 whereby one of said vertical dikes is positioned adjacent said insulated partition and said conduit including an outlet opening aligned with an inlet opening in said storage chamber.

5. In a refrigerator comprising an insulated cabinet containing freezer and fresh food storage compartments separated by an insulated partition and having separate access openings at the front of said cabinet:

a door having an outer door member and an inner door member movable to open and close said access opening to said fresh food storage compartment;

an evaporator chamber in said freezer compartment;

an evaporator in said evaporator chamber;

air supply means including fan means for drawing return air from both of said compartments over said evaporator and discharging refrigerated air into said freezer compartment and into said fresh food compartment;

wall means on said inner door member defining a storage chamber separate from said fresh food storage compartment including an inner access opening to said storage chamber;

an inner door mounted on said wall means dimensioned to provide air flow between said storage chamber and said fresh food compartment;

means on said outer door member forming an exterior access opening leading into said storage chamber;

a secondary door on said outer door member movable to open and close said exterior access opening for providing access to said storage chamber; and means for maintaining a desired temperature in said storage chamber comprising a conduit in said partition and a passageway in said wall means of said storage chamber positioned so as to communicate with said conduit for conveying a controlled amount of refrigerated air from said freezer compartment to said storage chamber to thereby maintain said storage chamber at said desired temperatures and to replenish refrigerated air to said storage chamber lost to outside ambient when said secondary door is in its open position.

6. The refrigerator recited in claim 5 whereby the wall means on said door includes vertical dikes formed on an inner door member spaced to provide the side walls of said storage chamber, and a horizontal dike providing the top wall of said storage chamber.

7. The refrigerator received in claim 6 whereby said wall means further including a receptacle extending horizontally between said vertical dikes defining the lower wall of said storage chamber.

8. The refrigerator recited in claim 7 whereby one of said vertical dikes is positioned adjacent said insulated partition and said conduit including an outlet opening aligned with an inlet opening in said storage chamber.

* * * * *